US010683109B2

(12) United States Patent
Rundell et al.

(10) Patent No.: US 10,683,109 B2
(45) Date of Patent: Jun. 16, 2020

(54) SYSTEM, APPARATUS AND METHOD OF PLACING AN INSERT IN A BAG

(71) Applicants: Wayne G. Rundell, Ashland, WI (US); Jim Scott, Washburn, WI (US); James R. Michler, Ashland, WI (US); Brett Fredericks, Drummond, WI (US)

(72) Inventors: Wayne G. Rundell, Ashland, WI (US); Jim Scott, Washburn, WI (US); James R. Michler, Ashland, WI (US); Brett Fredericks, Drummond, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 255 days.

(21) Appl. No.: 15/664,695

(22) Filed: Jul. 31, 2017

(65) Prior Publication Data

US 2018/0050827 A1 Feb. 22, 2018

Related U.S. Application Data

(60) Provisional application No. 62/377,785, filed on Aug. 22, 2016.

(51) Int. Cl.
*B65B 5/04* (2006.01)
*B65B 43/60* (2006.01)
(Continued)

(52) U.S. Cl.
CPC ..... *B65B 5/045* (2013.01); *B65B 43/12* (2013.01); *B65B 43/30* (2013.01); *B65B 43/50* (2013.01); *B65B 43/60* (2013.01); *B65B 61/20* (2013.01)

(58) Field of Classification Search
CPC ..... B65B 5/045; B65B 43/50; B65B 43/12; B65B 61/20; B65B 43/30; B65B 43/60;
(Continued)

(56) References Cited

U.S. PATENT DOCUMENTS 3,830,038 A * 8/1974 Propst ..... B65B 43/18 53/77
3,884,010 A * 5/1975 Bardo ..... B43M 7/02 53/492

(Continued)

FOREIGN PATENT DOCUMENTS

JP H11314602 A 11/1999

*Primary Examiner* — Hemant Desai
*Assistant Examiner* — Christopher Robin Kim
(74) *Attorney, Agent, or Firm* — Reinhart Boerner Van Deuren P.C.

(57) ABSTRACT

A bag carrying mechanism for a bag and insert combining apparatus for combining a stream of inserts with a stream of bags is provided. The bag carrying mechanism includes a plurality of bag holding arrangements operably coupled to one another for rotation about a rotational axis. Each bag holding arrangement includes first and second segments movable relative to one another and forming a receiving cavity therebetween. First and second holding features hold opposite sides of the bag within the receiving cavity and selectively hold the bag in an open position for receipt of an insert through an open end of the bag. Methods of using the bag carrying mechanism and systems incorporating the bag carrying mechanism are provided.

30 Claims, 5 Drawing Sheets

(51) Int. Cl.
*B65B 43/30* (2006.01)
*B65B 61/20* (2006.01)
*B65B 43/12* (2006.01)
*B65B 43/50* (2006.01)

(58) Field of Classification Search
CPC ..... B65B 5/067; B65B 25/145; B65B 35/243; B65B 43/14
USPC ..... 53/459, 469, 570, 284.7, 384.1, 386.1, 53/92, 249–251, 253
See application file for complete search history.

(56) References Cited

U.S. PATENT DOCUMENTS 4,019,546 A * 4/1977 Hastrup ..... B65B 1/18 141/10
4,172,349 A 10/1979 Lipes
4,174,599 A * 11/1979 Callet ..... B65B 43/30 53/512
4,586,320 A * 5/1986 Takai ..... B65B 31/022 53/374.8
4,674,258 A 6/1987 Ehlscheid et al.
5,222,535 A * 6/1993 Roders ..... B65B 43/465 141/114
5,555,793 A * 9/1996 Tocchet ..... G07F 9/105 221/150 A
5,639,083 A * 6/1997 Doucet ..... B65H 29/40 270/60
5,899,448 A * 5/1999 Hosking ..... B65H 1/025 271/110
5,975,525 A * 11/1999 Hartmann ..... B65H 29/40 270/39.09
6,000,334 A * 12/1999 Suzuki ..... B65H 29/40 101/227
6,216,591 B1 * 4/2001 Nanba ..... B65H 29/40 101/232
6,282,871 B1 * 9/2001 Killinger ..... B65B 43/123 53/459
6,354,591 B1 * 3/2002 d'Agrella ..... B65H 29/40 271/182
6,494,448 B2 * 12/2002 Duhamel ..... B65H 29/40 271/187
6,877,740 B2 * 4/2005 Michler ..... B65H 29/40 271/187
7,162,852 B2 * 1/2007 Eder ..... B65B 3/04 141/114
7,954,307 B2 * 6/2011 Paunesku ..... B65B 1/363 53/459
8,006,826 B2 8/2011 Licht
8,453,417 B2 6/2013 Oshio et al.
9,169,085 B2 10/2015 Schill et al.
2003/0021659 A1 * 1/2003 Michler ..... F16F 9/306 414/315
2003/0021668 A1 * 1/2003 Michler ..... B65H 31/32 414/789.9
2003/0074866 A1 * 4/2003 Koppe ..... B65B 43/465 53/459
2003/0082044 A1 * 5/2003 Gendron ..... B65H 31/06 414/789.9
2006/0175344 A1 * 8/2006 Skarda ..... B65H 3/22 221/258
2006/0207220 A1 * 9/2006 Ford ..... B65B 65/003 53/398
2007/0074492 A1 4/2007 Koga et al.
2007/0228066 A1 * 10/2007 Almas ..... B65D 83/0858 221/211
2008/0000198 A1 * 1/2008 Setozaki ..... B65B 43/30 53/396
2008/0110132 A1 * 5/2008 Yan Ruz ..... B65B 43/18 53/459
2010/0224647 A1 * 9/2010 Formon ..... B65H 3/40 221/13
2011/0109032 A1 * 5/2011 Keller ..... B65H 5/305 270/58.06
2011/0114660 A1 * 5/2011 Johansson ..... A61F 15/001 221/43
2011/0232229 A1 * 9/2011 Rea ..... B29C 66/8221 53/167
2013/0161346 A1 * 6/2013 Wolme ..... A47K 10/424 221/26
2015/0298882 A1 10/2015 Thompson
2018/0050827 A1 * 2/2018 Rundell ..... B65B 43/30

* cited by examiner

SYSTEM, APPARATUS AND METHOD OF PLACING AN INSERT IN A BAG

CROSS-REFERENCE TO RELATED PATENT APPLICATION

This patent application claims the benefit of U.S. Provisional Patent Application No. 62/377,785, filed Aug. 22, 2016, the entire teachings and disclosure of which are incorporated herein by reference thereto.

FIELD OF THE INVENTION

This invention generally relates to systems and methods of combining a stream of inserts with a stream of bags.

BACKGROUND OF THE INVENTION

It is often desired to insert items into bags. For instance, fast food restaurants will often provide the food items in a bag. Along with the food items, napkins or other items are often inserted into the bag, such as condiments as well as utensils.

Several reoccurring problems are noted by customers of these establishments. One primary complaint is that the restaurant worker fails to provide one of the inserts and primarily the napkins. Another problem is that when the purchaser grabs their own napkins, they will often take many more napkins than are needed resulting in excessive waste and expense for the restaurant.

The present invention provides an improvement over the current state of the art of filling bags with inserts.

BRIEF SUMMARY OF THE INVENTION

Embodiments of the invention provide a device for assisting in filling bags with an insert, such as napkin(s), condiments, spoons, coupons, flyers, etc. In a particular embodiment, a bag carrying mechanism for a bag and insert combining apparatus is provided. The bag carrying mechanism includes a plurality of bag holding arrangements and a control device. The bag holding arrangements are angularly spaced apparat and are operably coupled to one another for rotation about a rotational axis. Each bag holding arrangement includes a first arm segment and a second arm segment positioned adjacent the first arm segment. The arm segments form a receiving cavity therebetween. The first and second arm segments are movable relative to one another to adjust a spacing between the first and second arm segments. To be movable relative to one another, only one or both of the arm segments need be movable. Each first arm segment includes a first holding feature for holding a first side of a bag received in the receiving cavity. Each second arm segment including a second holding feature for holding a second side of the bag received in the receiving cavity. The control device moves the first and second arm features away from one another while the first holding feature is holding the first side of the bag and the second holding feature is holding the second side of the bag to maintain the bag in an open state. Thus, after a bag is received in the receiving cavity, the motion of the arm segments relative to one another opens the bag and maintains the bag in the open state.

In one embodiment, the control device moves the first and second arm features toward one another after the bag is received in the receiving cavity and prior to moving the first and second arm features away from one another while the first holding feature is holding the first side of the bag and the second holding feature is holding the second side of the bag to maintain the bag in an open state.

In one embodiment, the control mechanism includes a cam surface that cooperates with a cam follower of at least one of the first and second arm segments.

In one embodiment, the first holding feature is at least one vacuum port facing the second arm segment of the corresponding holding arrangement. The second holding feature is at least one second vacuum port facing the first arm segment of the corresponding holding arrangement.

In one embodiment, the first arm segments are in a fixed position relative to one another and the second arm segments are configured to move relative to the first arm segments.

In one embodiment, a carrying body is configured to rotate about the rotational axis. Each first arm segments is in a fixed position relative to the carrying body. Each second arm segment being movably mounted to the carrying body to allow the first and second arm segments to be movable relative to one another to adjust the spacing between the first and second arm segments.

In one embodiment, each second arm segment is pivotably mounted to the carrying body for rotation about a corresponding second arm segment rotational axis.

In one embodiment, a stripping mechanism for interfering with an end of the bag within the receiving cavity to remove the bags from the receiving cavities as the holding arrangement travel past the stripping mechanism by preventing continued rotation of the bag around the rotational axis with the bag holding arrangement is provided.

In another embodiment, a bag and insert combining apparatus for combining a stream of bags with a stream of inserts is provided. The apparatus includes a bag carrying mechanism as described above, a bag feeding apparatus and an insert feeding mechanism. The bag feeding apparatus feeds a stream of bags to the bag carrying mechanism and drives each bag into one of the receiving cavities of the bag carrying mechanism. The insert feeding mechanism feeds the stream of inserts to the bag carrying mechanism and drives an insert into the bag when the bag is in the open state.

In one embodiment, the receiving cavity has a tangential velocity as it rotates about the rotational axis. The bag feeding apparatus drives the bags into the receiving cavities at a first speed greater than the tangential velocity of the receiving cavity, at least measured at the mouth of the receiving cavity. The insert feeding mechanism drives the inserts into the bags at a second speed greater than the tangential velocity.

In one embodiment, the insert feeding mechanism feeds napkins.

In one embodiment, the insert feeding mechanism feeds a plurality of napkins into each bag, such that each insert is a plurality of napkins.

In one embodiment, the insert feeding mechanism provides a plurality of webs of material for forming the plurality of napkins. The webs of material are overlapped and severed to simultaneously form the plurality of napkins.

In one embodiment, the bag carrying mechanism includes a stripping mechanism for interfering with an end of the bag within the receiving cavity to remove the bags from the receiving cavities as the holding arrangements travel past the stripping mechanism.

In one embodiment, a conveyor receives the bags that have been stripped from the holding arrangements and carries the bags away from the bag carrying mechanism.

A method of inserting inserts into bags is provided. The method includes providing a stream of bags to a bag carrying mechanism according the embodiments outlined herein. The method includes inserting the bags of the stream of bags into the receiving cavities of the bag holding arrangements. The method includes maintaining, for each bag, an open end of the bag in an open state. The bags are maintained in an open state by holding a first side of a bag received in the receiving cavity with a first holding feature and holding a second side of the bag received in the receiving cavity with a second holding feature. The method includes providing a stream of inserts to the bag carrying mechanism. The method includes inserting the inserts into the bags to form a bag and insert combination.

In one method, a single bag is inserted into each receiving cavity.

In one method, each bag receives only a single insert.

In one method, each bag receives multiple inserts.

In one method, the method includes moving the first and second arm features away from one another while the first holding feature is holding the first side of the bag and the second holding feature is holding the second side of the bag to maintain the open end of the bag in an open state.

In one method, the method includes moving the first and second arm features toward one another after a bag is inserted therebetween and prior to moving the first and second arm features away from one another while the first holding feature is holding the first side of the bag and the second holding feature is holding the second side of the bag to maintain the open end of the bag in an open state.

In one method, the method includes stripping each bag and insert combination from the bag carrying mechanism by abutting a closed end of the bag against a stripping mechanism.

In one method, the method includes receiving the stripped bag and insert combinations on a conveyor and carrying the stripped bag and insert combinations away from the bag carrying mechanism with the conveyor.

In another embodiment, a bag carrying mechanism for a bag and insert combining apparatus is provided. The bag carrying mechanism includes a plurality of bag holding arrangements. The plurality bag holding arrangements are angularly spaced apart. The bag holding arrangements are operably coupled to one another for rotation about a rotational axis. Each bag holding arrangement includes a first holding feature for holding a first side of a bag received in the receiving cavity and a second holding feature for holding a second side of the bag received in the receiving cavity.

In one embodiment, the first and second holding features are vacuum ports.

In one embodiment, each bag holding arrangement includes a first arm segment and a second arm segment positioned adjacent the first arm segment forming a receiving cavity therebetween.

In one embodiment, for each bag holding arrangement, the first and second arm segments are movable relative to one another to adjust a spacing between the first and second arm segments.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
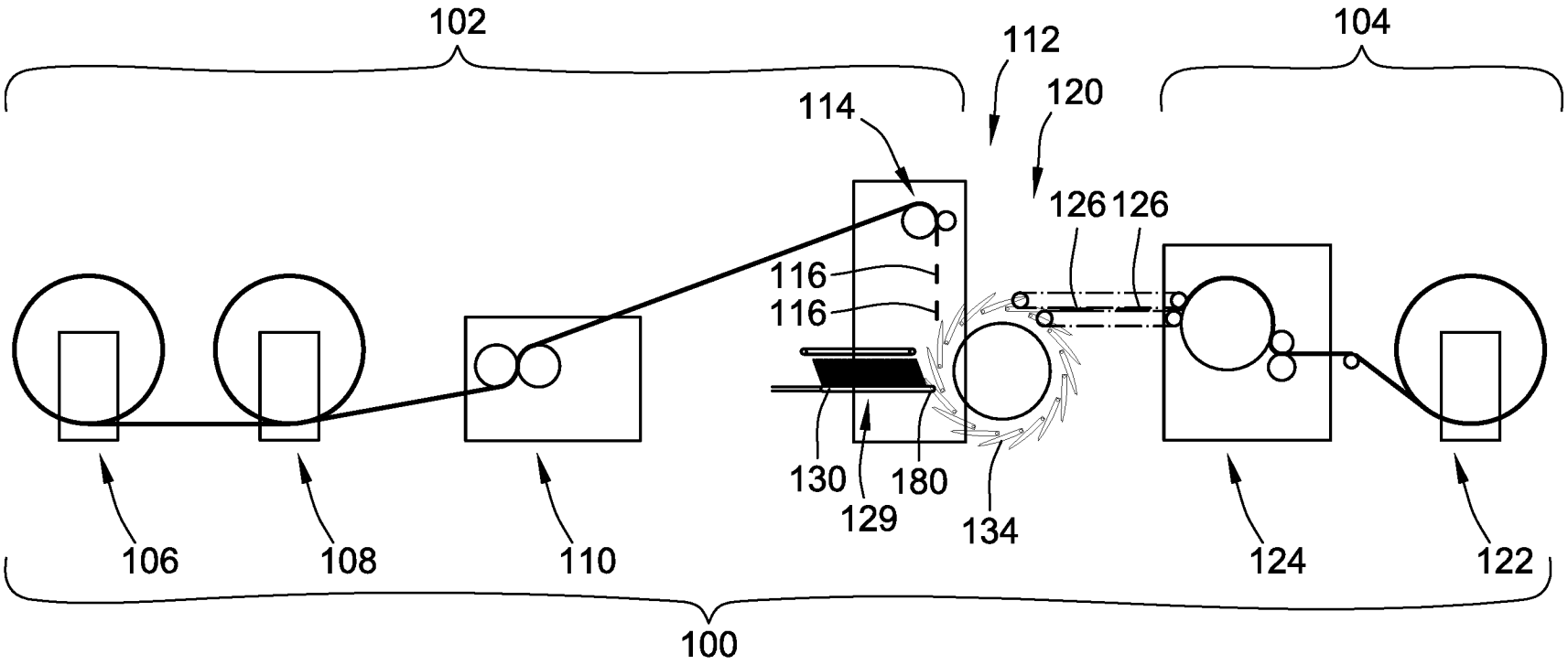
FIG. 1 is a schematic, simplified illustration of a system for forming a stream of inserts, forming a stream of bags, and combining the stream of inserts with the bags by filling the bags with the inserts.

FIG. 1 illustrates an embodiment of a bag and insert combining apparatus 100 (also referred to as a combining apparatus 100). The combining apparatus 100 is used to insert inserts into bags. Typically, a stream of inserts will be combined with a stream of bags such that each bag receives one or more inserts. The inserts are not necessarily limited and in some embodiments could be in the form of flyers, coupons, napkins, etc. The system will be described principally with the insert being napkins.

The combining apparatus 100 has an insert supplying system that is in the form of a napkin forming machine 102. The napkin forming machine 102 forms a stream of napkins 116 that are inserted into bags 126 formed from a bag forming machine 104. Both the napkin forming machine 102 and the bag forming machine 104 are illustrated in schematic simplified form. However, some detail will be provided for each system.

The napkin forming machine 102 includes, in the illustrated embodiment, a pair of web supply stands 106, 108 for holding rolls of continuous web that is used for forming the napkins. Each web is used to form a separate napkin that will be inserted into a same bag. As such, in this embodiment, two napkins are fed into each bag. Using this design, if four napkins were to be fed into a single bag, four separate webs would be provided on, e.g., four separate web supply stands. The web supply stands are often referred to as unwind stands where the rolls of web are unwound. Other structures for controlling the tension of the webs as well as for replacing spent rolls of web material may be included. In other embodiments, more than one napkin could be formed from a single web and need not be formed from separate webs.

In this embodiment, the napkin forming machine 102 includes downstream systems for manipulating the web of material prior to being formed into individual napkins. In the illustrated embodiment, an embosser/printer 110 is provided to manipulate the web of material.

The napkin forming 102 machine includes a napkin forming and inserting apparatus 112. The napkin forming and inserting apparatus is a form of an insert feeding mechanism used to feed inserts into bags as will be described in more detail below. In the illustrated embodiment, the continuous webs of material are received by the napkin forming and inserting apparatus 112 and then severed to form a stream of individual napkins. A cutting arrangement 114 may be used to sever the continuous webs of material. In the illustrated embodiment, the cutting arrangement 114 includes a cutting roll and an anvil roll that cooperate with one another to sever the web of material. Severed napkins 116 are illustrated schematically in FIG. 1.

Machines for forming the stream of napkins are generally well known.

The formed napkins are operably fed into bags that are carried by a bag carrying mechanism 120 illustrated in the form of a starwheel.

The bags are formed by the bag forming machine 104. In the illustrated embodiment, a web supply stand 122 carries the material that is used to form the bags. The web of material is fed to a bag maker 124 which makes the bags.

In one embodiment, the bags are paper bags that have at least opposed sides that form an internal cavity therebetween. An open end will provide access to the internal cavity. These two sides may be connected by hinge regions on opposite edges of the sides to allow the sides to be, at least in part, moved away from one another to open the open end to allow access to the internal cavity. In some embodiments, the bag may have four sides, first and second opposed sides that are generally parallel to one another and third and fourth sides that are generally parallel to one another and that extend between the first and second sides when the bag is expanded. This provides a generally rectangular cross-section to the open internal cavity. Further, each of the third and fourth sides may be formed from pairs of hinged panels to assist in allowing the bag to be folded to a flat state. One of the panels would be hinged to the first side, the other panel would be hinged to the second side and the two panels would be hinged together. Further yet, the bag will typically have a closed bottom. Again, the bottom will typically be configured such that it can be folded flat for easy storage. Machines for forming various bags for use in the combining apparatus are well known. Further, it is contemplated that plastic bags or bags of other materials as well as bags with other wall or bottom configurations can be used/made with systems incorporating features of embodiments of the present invention.

Formed bags 126 are illustrated schematically in FIG. 1.

Once the inserts, e.g. napkins 116 are inserted into the bags 126 in the bag carrying mechanism 122, a stripping mechanism 129 strips the bag and napkin combinations (also referred to generically as bag and insert combinations) from the bag carrying mechanism 120. The bag and napkin combinations are then pushed away from the bag carrying mechanism 120 by the outer surface of first arm segments 134 along the stripping mechanism 129 and a discharge table 130. In other embodiments, a conveyor may carry the combinations away from the stripping mechanism.

Figure 2:
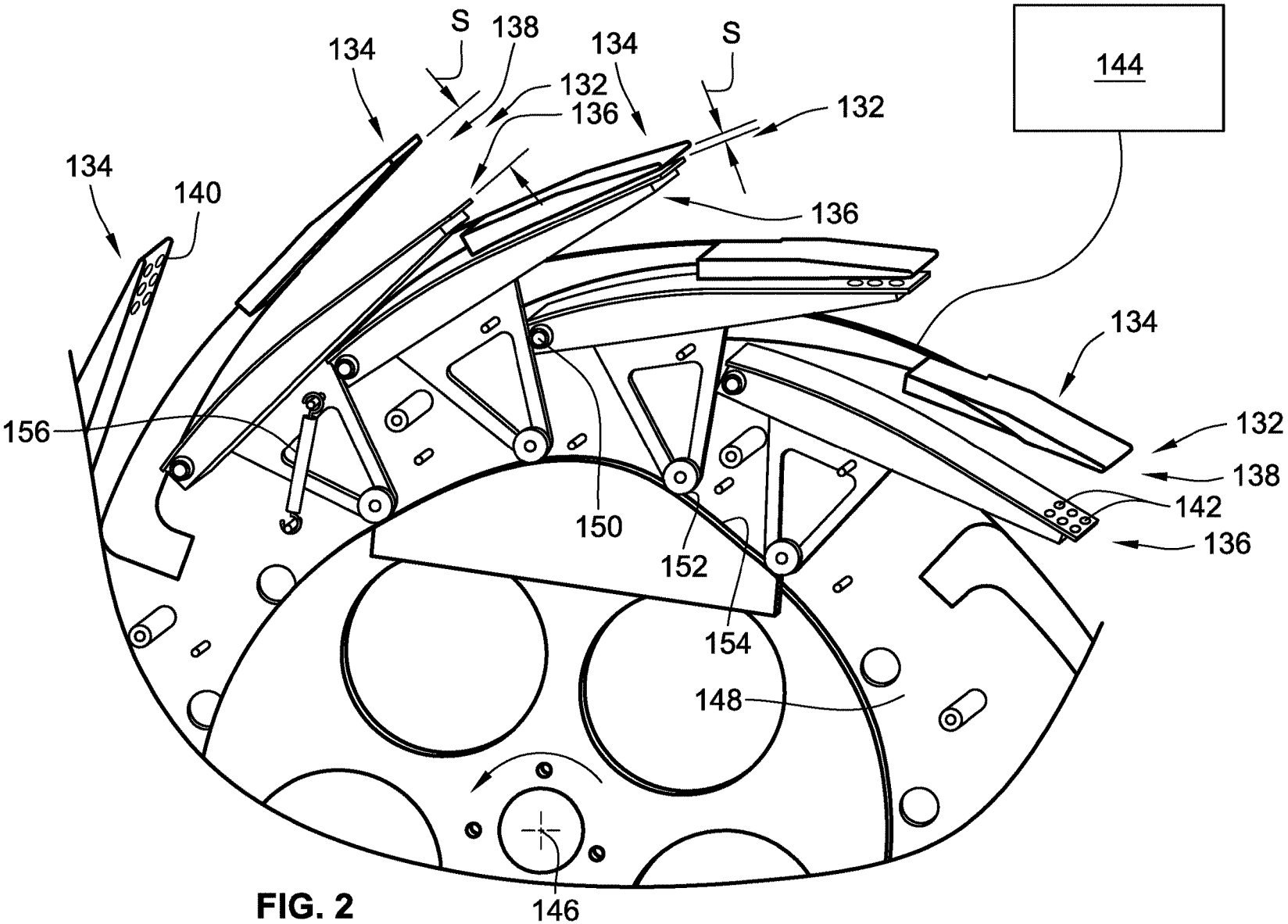
FIG. 2 is an enlarged, partial, simplified, perspective view of a bag carrying mechanism for use in the system of FIG. 1.

FIG. 2 is a simplified partial illustration of a bag carrying mechanism 120. The bag carrying mechanism 120 is used to combine the stream of bags 126 and inserts, e.g. napkins 116.

The bag carrying mechanism 120 includes a plurality of angularly spaced apart bag holding arrangements 132. Each bag holding arrangement 132 includes first and second arm segments 134, 136 that define a receiving cavity 138 therebetween. In operation, each receiving cavity 138 will receive a single bag 126 (not shown in FIG. 2). The first arm segment 134 will include a first holding feature 140, illustrated in the form of a plurality of vacuum ports (and also referred to herein as vacuum ports 140). The second arm segment 136 will include a second holding feature 142, illustrated in the form of a plurality of vacuum ports (also referred to herein as vacuum ports 142). Here, vacuum ports 140, 142 face toward each other for a given bag holding arrangement 132.

The vacuum ports 140, 142 are operably connected to a vacuum source 144 shown schematically in FIG. 2, for supplying a vacuum. When a bag is received in the receiving cavity 138, the vacuum from vacuum source 144 will be applied to pull the opposed first and second sides away from one another to open the open end of the bag 126 to allow for insertion of the insert, e.g. napkin 116. Some embodiments may allow the vacuum source 144 to selectively turn on and turn off vacuum to the vacuum ports 140, 142 to reduce waste as well as to allow for improved insertion of the bags 126 into the receiving cavities 138.

While not illustrated, a deceleration device may be provided proximate (e.g. next to or within) the receiving cavity 138. The deceleration device slows the bags as they are received by the bag holding arrangements 132 to prevent the bags from bouncing back out of the receiving cavity 138 and creating improper alignment of the bags within the receiving cavity 138. Such improper alignment could affect downstream operation of the system when inserts are inserted into the bags. An example of a deceleration device would be a device that provides increased frictional engagement to a surface of the bag as it is received into the receiving cavity. Preferably, this would occur after the bag has been substantially entirely inserted into the receiving cavity. For example, a material with increased frictional engagement could be provided proximate a bottom end of the receiving cavity 138 to prevent the bag from backing out of the receiving cavity 138. For example, a strip of rubber could be provided proximate a bottom end of the receiving cavity 138, e.g. opposite a mouth where the bag is initially inserted into the receiving cavity 138. In an alternative embodiment, a biased member could provide increased pressure or force on the surface of the bag to prevent bounce back. The biased member may be configured to increase gripping force as the bag attempts to bounce out of the receiving cavity 138. Again, the biasing member would typically be positioned such that it begins to operate once the bag is substantially fully received in the receiving cavity. However, the biasing member would not be so aggressive that the bag could not be dispensed from the bag carrying mechanism 120 after receipt of the insert. Further, the biasing mechanism could be configured to be released or the gripping force reduced after the bag has been fully inserted into the receiving cavity 138 to facilitate removal of the bag at the desired time, e.g. after the insert has been received in the bag. Such a biasing member may or may not also incorporate a material to increase frictional engagement. Further, the biasing member could, while being used, work such that it increases force as the bag attempts to bounce back out of the receiving cavity 138.

In the illustrated embodiment, the bag holding arrangements 132 are operably coupled to one another for simultaneous rotation about a rotational axis 146. In this embodiment, the first and second arm segments 134, 136 are carried by a carrying body 148 that rotates about axis 146 such that the holding arrangements 132 rotate about axis 146.

In the illustrated embodiment, the first arm segment 134 of each holding arrangement 132 is part of carrying body 148 and is in a fixed orientation to the rest of the carrying body 148. In other embodiments, the first arm segment is a separate component operably attached to the carrying body 148.

In this embodiment, to improve opening of the open end of the bag, the second arm segment 136 of each holding arrangement 132 is movably attached to the carrying body 148. As such, the first and second arm segments 134, 136 of each holding arrangement 132 are movable relative to one another to adjust a spacing S between the first and second arm segments 134, 136. More particularly, the spacing S can be increased when bags are being driven into the receiving cavity 138, brought together when vacuum is applied to the holding features 140, 142, and then spaced apart again when an insert, e.g. napkin 116, is inserted into the bag 126.

While only the second arm segment 136 is illustrated as being movable relative to carrying body 148, other embodiments could have both arm segments 134, 136 movable. It is also contemplated that a system could be formed where neither arm segment is movable. However, the movability is contemplated to improve the consistency of properly controlling the opposed sides of the bag using the holding features 140, 142.

In the illustrated embodiments, the second arm segments 136 pivot about a second arm segment rotational axis 150 defined by a pivotal connection securing the second arm segments 136 to the carrying body 148.

The bag carrying mechanism 120 includes a control arrangement for selectively moving the first and second arm segments 134, 136 relative to one another. The control arrangement in the illustrated embodiment is a cam and cam follower arrangement. More particularly, the second arm segments 136 each include a cam follower 152 that cooperates with a cam surface 154 to control the motion of the second arm segment 136 as the arm segment 136 rotates around rotational axis 146. A spring 156 is used to bias the cam follower 152 against the cam surface 154. In this embodiment, the spring 156 biases the second arm segment 136 away from the first arm segment 134. Other control arrangements are contemplated. For instance, the second arm segment 136 could be driven by electronic, pneumatic, or hydraulic means such as electric motors or hydraulic or pneumatic actuators. Mechanical valving or switching could be employed to activate the different actuators. Alternatively, electronic controllers could be used to control the different actuators. Further, the motion of the arm segments 134, 136 need not be rotational but could be strictly linear translation.

Figure 3:
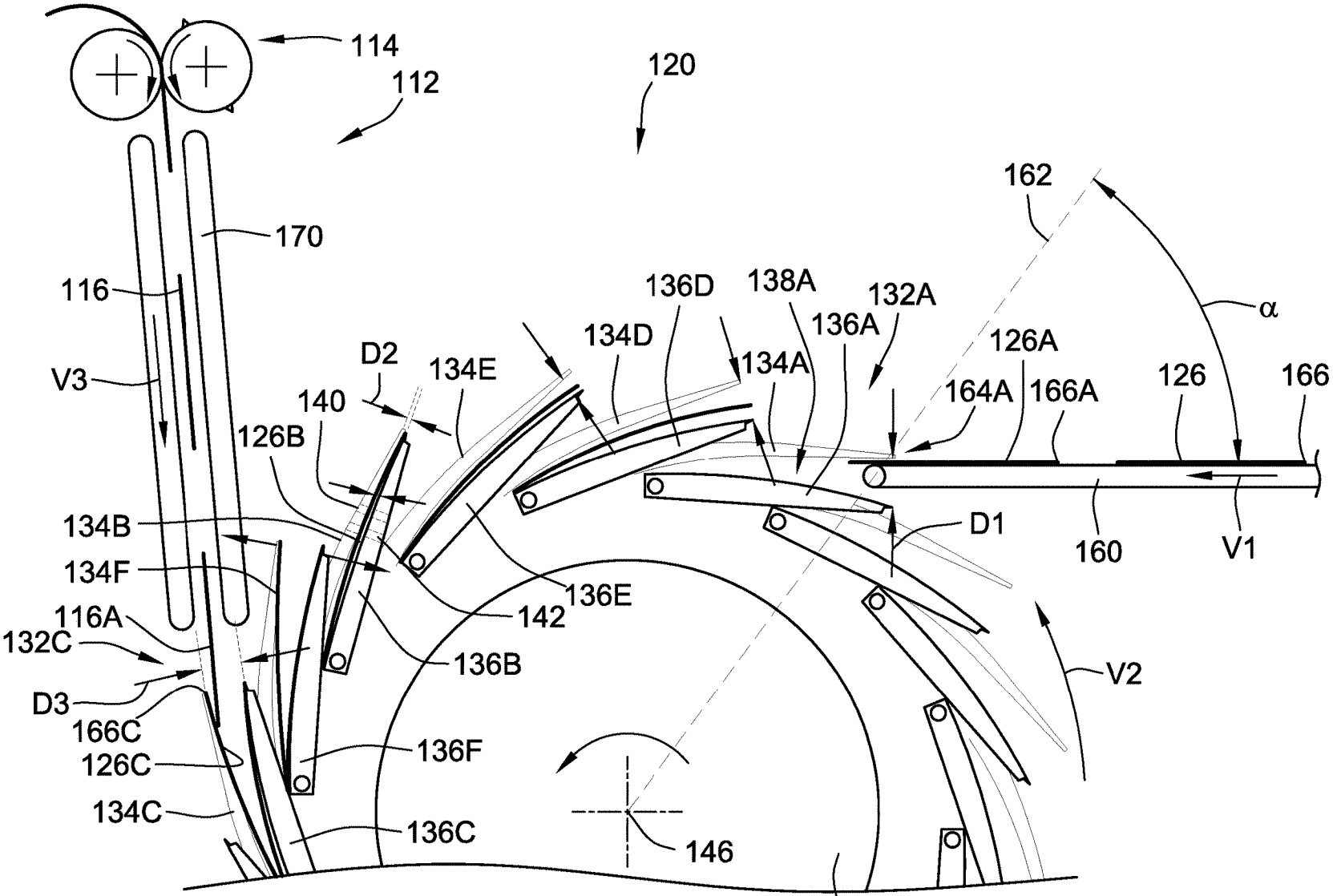
FIG. 3 is a schematic partial illustration of the bag carrying mechanism of FIG. 2 in use.

With reference to FIG. 3, a bag feeding apparatus 160 feeds a stream of bags 126 to the bag carrying mechanism 120. More particularly, one bag is driven/fed into each of the receiving cavities 138 as the corresponding bag holding arrangement 132 passes by the bag feeding apparatus 160. In FIG. 3, bag 126A is being driven into receiving cavity 138A of bag holding arrangement 132A.

The bag feeding apparatus 160 supplies the bags 126 to the bag carrying mechanism 120 at an angle $\alpha$ of between about 10 degrees and 80 degrees relative to radius 162 at the mouth 164A of the receiving cavity 138A. In this position, the first and second arm segments 134A, 136A have a spacing that is a first distance D1 that is large to increase the size of mouth 164A to facilitate easy insertion of the bag 126A into the receiving cavity 138A. The bags 126 are driven at a first tangential velocity V1 by the bag feeding apparatus 160 that is greater than the tangential velocity V2 of the receiving cavity 138A.

Typically, any vacuum to any holding features, e.g. vacuum ports, would be turned off as the bags 126 are being inserted into the bag carrying mechanism 120 to facilitate easy insertion. Further, in this embodiment, the bags 126 are, preferably, in a fully folded and closed state with the open ends 166 generally closed, e.g. with opposed sides of the bags close together.

After receiving a bag 126, the first and second arm segments 134D, 134E, 136D, 136E move towards one another to decrease spacing S, illustrated by inward facing arrows in FIG. 3, as the bag holding mechanism 120 rotates about axis 146. Further, the vacuum to these arm segments 134D, 134E, 136D, 136E is turned on. First and second arm segments 134B, 136B are in a closed orientation relative to one another such that the spacing therebetween is substantially eliminated and the distance therebetween is a second distance D2. The second distance D2 is less than first distance D1 when the bag 126A is being inserted into the receiving cavity 138A. Further, the vacuum has been turned on to vacuum ports 140, 142 (see FIG. 2) such that the opposed sides of the bag 126B are gripped by the vacuum ports 140, 142.

As the bag holding mechanism 120 continues to rotate about the rotational axis 146, the first and second arm segments 134F, 136F are moved relative to one another to increase the spacing a third distance D3 therebetween, which is greater than distance D2. This is illustrated by outward facing arrows. With reference to bag holding arrangement 132C, this relative motion of the two arm segments 134C, 136C, also opens the open end 166C of bag 126C to prepare the bag 126C for insertion of an insert, e.g. napkin 116A. Distance D3 may be the same or different than distance D1. Bag 126C is now traveling at tangential velocity V1 as it is fully under control of the bag carrying mechanism 120.

The cam surface 154 and cam followers 152 (FIG. 2) are used to control the motion of the second arm segments 136 to control this repetitive opening and closing action. Again, while only the second arm segments (e.g. trailing arm segments) are illustrated as moving in this embodiment, other embodiments could have the leading arm segment moving or neither arm segment moving to effectuate opening of the open end of the bags.

The insert feeding apparatus 112 forms a stream of napkins 116 and feeds the napkins 116 with an insert feeding mechanism 170 into the open ends 166 of the bags 126. In FIG. 3, napkin 116A is being inserted into open end 166C of bag 126C. The insert feeding mechanism 170 is synchronized with the bag carrying mechanism 120 and drives the napkins 116 at a velocity V3 that is greater than tangential velocity V2. Further, because the insert feeding mechanism 170 cannot interfere with or otherwise intertwine with the bags 126, the direction of insertion of the inserts, e.g. napkins 116 is preferably substantially vertical (e.g. oriented parallel to gravity) plus or minus 10 degrees. This prevents undesirable bending of flexible inserts, e.g. napkins 116, due to gravity once portions thereof are no longer directly controlled by the insert feeding mechanism 170.

The bag feeding apparatus 160 and insert feeding mechanism 170 may be provided by conveyors, which may be flexible belts configured to control the motion of the bags 126 and napkins 116.

Figure 4:
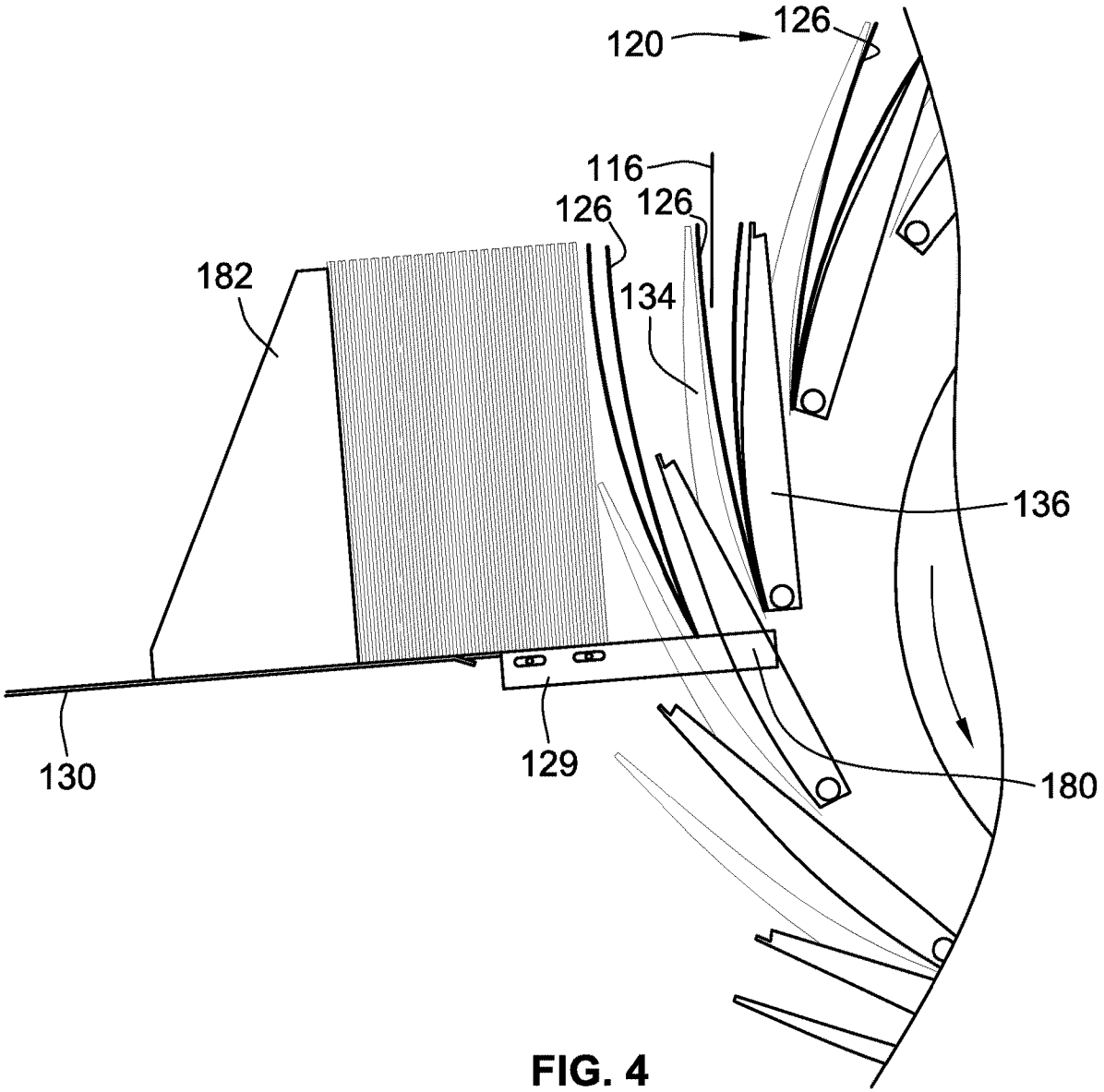
FIGS. 4 and 5 better illustrate the stripping mechanism against which the bags abut to be removed from the bag carrying mechanism of FIG. 2.

Once the inserts, e.g. napkins 116, are inserted into the bags 126 within the bag carrying mechanism 120 forming a bag and insert combination illustrated in the form of a bag and napkin combination, the bag and napkin combination is removed from the receiving cavity 138 and carried away from the bag holding arrangement 120 by conveyor 130 (see e.g. FIGS. 1 and 4). Typically, a stripping mechanism in the form of an abutment or other mechanism will interfere with a bottom end, of the bag 126, e.g. opposite open end 166, to stop motion of the bag 126 imparted by the bag carrying mechanism 120. Due to the curved shape of the first arm segments 134, the first arm segments 134 will push the bag and insert combinations outward away from the bag carrying mechanism 120.

Figure 5:
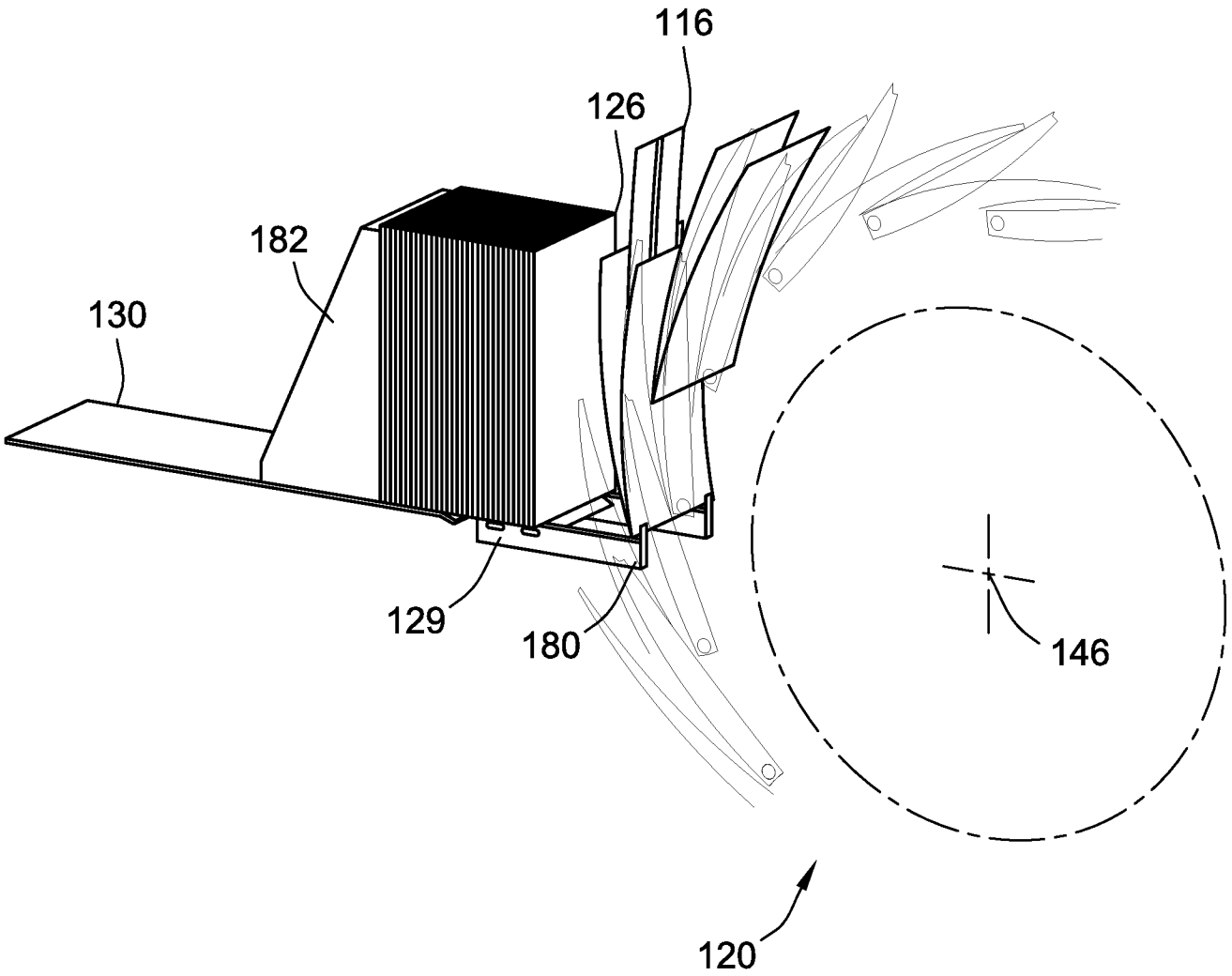

In FIGS. 1, 4 and 5, the stripping mechanism 129 penetrates an outer circular periphery defined by the bag carrying mechanism 120. In the illustrated embodiment, the stripping mechanism 129 straddles the bag carrying mechanism 120 with one or more abutments that will abut and interfere with portions of the bags 126 that extend transversely, e.g. parallel to axis 146, out of the receiving cavity 138. Alternatively, one or both of the first and second arm segments 134, 136 could include slots through which the stripping mechanism extends to allow for the interference and stripping of the bags 126 from the receiving cavities 138. An end 180 of the stripping mechanism 129 is shown penetrating the outer circular periphery of the bag carrying mechanism 120. The bags and insert combinations are then pushed along the top surface of the stripping mechanism 129 and along discharge table 130 by the bag carrying mechanism 120. A movable product support 182 provides back pressure.

Embodiments of the present invention allow for mass production of bags that are prefilled with an insert, such as for example napkins. The prefilled bags prevent the need of having to remember to provide the insert. The prefilled bags also prevent an undesirable number of inserts from being used.

By using embodiments of the system above, different systems could be configured to provide more or less inserts depending on the number of inserts that are needed. For example, different sized bags configured to hold different amounts of food could have different number of napkins prefilled. Thus, a large bag could have, for example, eight napkins prefilled into the bags. Alternatively, a small bag could have, for example, four napkins prefilled into the bags. Thus, the restaurant worker would not have to make a decision as to how many napkins to put in the bag nor would the worker be required to put any napkins in the bag eliminating two of the primary issues surrounding fast food.

Similar situations would work for fliers, coupons, etc. for other establishments. For example, a clothing store may be running a promotion with coupons and they could have their bags prefilled with the appropriate insert, e.g. coupons.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A bag carrying mechanism for a bag and insert combining apparatus, the bag carrying mechanism comprising:

a plurality of angularly spaced apart bag holding arrangements, the bag holding arrangements operably coupled to one another for rotation about a rotational axis being horizontal;

each bag holding arrangement of the plurality of angularly spaced apart of the bag holding arrangements including a first arm segment and a second arm segment positioned adjacent the first arm segment forming a receiving cavity therebetween, the first and second arm segments being movable relative to one another to adjust a spacing between the first and second arm segments;

the first arm segment of each bag holding arrangement including a first holding feature for holding a first side of a bag received in the receiving cavity;

the second arm segment of each bag holding arrangement including a second holding feature for holding a second side of the bag received in the receiving cavity; and a control device moving the first and second arm segments away from one another while the first holding feature is holding the first side of the bag and the second holding feature is holding the second side of the bag to maintain the bag in an open state; and wherein the bag holding arrangements maintain the bags in an open state when the bag holding arrangements carry the bags in a vertically downward direction as the bag holding arrangement travel in a vertically downward direction as the bag holding arrangements rotate about the rotational axis.

2. The bag carrying mechanism of claim 1, wherein the control device moves the first and second arm segments toward one another after the bag is received in the receiving cavity and prior to moving the first and second arm segments away from one another while the first holding feature is holding the first side of the bag and the second holding feature is holding the second side of the bag to maintain the bag in the open state.

3. The bag carrying mechanism of claim 1, wherein the control device includes a cam surface that cooperates with a cam follower of at least one of the first and second arm segments.

4. The bag carrying mechanism of claim 1, wherein:

the first holding feature is at least one vacuum port facing the second arm segment; and the second holding feature is at least one second vacuum port facing the first arm segment.

5. The bag carrying mechanism of claim 1, wherein the first arm segments are in a fixed position relative to one another and the second arm segments are configured to move relative to the first arm segments.

6. The bag carrying mechanism of claim 1, further comprising a carrying body, the carrying body configured to rotate about the rotational axis;

the first arm segments being in a fixed position relative to the carrying body; and the second arm segment being movably mounted to the carrying body to allow corresponding first and second arm segments to be movable relative to one another to adjust the spacing between the corresponding first and second arm segments.

7. The bag carrying mechanism of claim 6, wherein the second arm segment of each bag holding arrangement is pivotably mounted to the carrying body for rotation about a corresponding second arm segment rotational axis.

8. The bag carrying mechanism of claim 1, further comprising a stripping mechanism for interfering with an end of the bag within the receiving cavity to remove the bags from the receiving cavities as the bag holding arrangement travel past the stripping mechanism by preventing continued rotation of the bag around the rotational axis with the bag holding arrangement.

9. The bag carrying mechanism of claim 1, wherein the receiving cavity has a mouth and a bottom end, the mouth of the receiving cavity opening in a vertically upward direction with the bottom end being vertically below the mouth when the bag holing arrangement maintains the bag in the open state while the bag is being carried in the vertically downward direction.

10. The bag carrying mechanism of claim 1, wherein the first and second arm segments define a mouth to the receiving cavity, the first and second arm segments move relative to one another to adjust the spacing therebetween.

11. A bag and insert combining apparatus for combining a stream of bags with a stream of inserts comprising:

a bag carrying mechanism of claim 1;

a bag feeding apparatus for feeding a stream of bags to the bag carrying mechanism and driving the bag into one of the receiving cavities of the bag carrying mechanism; and an insert feeding mechanism feeding the stream of inserts to the bag carrying mechanism and driving an insert into the bag when the bag is in the open state, the insert feeding mechanism feeding the inserts into the bag along an insertion direction that is oriented vertically.

12. The bag and insert combining apparatus of claim 11, wherein:

the receiving cavity has a tangential velocity as the receiving cavity rotates about the rotational axis;

the bag feeding apparatus drives the bags into the receiving cavities at a first speed greater than the tangential velocity; and the insert feeding mechanism drives the inserts of the stream of inserts into the bags at a second speed greater than the tangential velocity.

13. The bag and insert combining apparatus of claim 11, wherein the insert feeding mechanism feeds napkins.

14. The bag and insert combining apparatus of claim 13, wherein the insert feeding mechanism feeds a plurality of napkins into each bag of the stream of bags.

15. The bag and insert combining apparatus of claim 14, wherein the insert feeding mechanism provides a plurality of webs of material for forming the plurality of napkins, wherein the webs of material are overlapped and severed to simultaneously form the plurality of napkins.

16. The bag and insert combining apparatus of claim 11, wherein the bag carrying mechanism includes a stripping mechanism for interfering with an end of the bag within the receiving cavity to remove the bags from the receiving cavities as the bag holding arrangements travel past the stripping mechanism; and wherein the bags are pushed away from the bag carrying mechanisms along a surface of the stripping mechanism by an outer surface of the first arm segments as the bag holding arrangements rotate about the rotational axis.

17. The bag and insert combining apparatus of claim 16, further comprising a conveyor receiving the bags that have been stripped from the bag holding arrangements and carrying the bags away from the bag carrying mechanism.

18. A method of handling a bag comprising:

providing a stream of bags to a bag carrying mechanism according to claim 1, inserting the bags of the stream of bags into the receiving cavities of the bag holding arrangements;

maintaining, for each bag, an open end of the bag in an open state by:

holding a first side of a bag received in the receiving cavity with a first holding feature; and holding a second side of the bag received in the receiving cavity with a second holding feature;

wherein the bags are maintained in an open state when the bag is being carried in the vertically downward direction that is oriented substantially parallel to gravity.

19. The method of claim 18, wherein a single bag is inserted into each receiving cavity.

20. The method of claim 18, further comprising moving the first and second arm features away from one another while the first holding feature is holding the first side of the bag and the second holding feature is holding the second side of the bag to maintain the open end of the bag in an open state.

21. The method of claim 20, further comprising moving the first and second arm features toward one another after a bag is inserted therebetween and prior to moving the first and second arm features away from one another while the first holding feature is holding the first side of the bag and the second holding feature is holding the second side of the bag to maintain the open end of the bag in an open state.

22. The method of claim 18, further comprising:

providing a stream of inserts to the bag carrying mechanism; and inserting the inserts into the bags to form a bag and insert combination, the inserts being inserted into the bags along an insertion direction that is substantially vertical.

23. The method of claim 22, wherein each bag receives only a single insert.

24. The method of claim 22, wherein each bag receives multiple inserts.

25. The method of claim 22, further comprising stripping each bag and insert combination from the bag carrying mechanism by abutting a closed end of the bag against a stripping mechanism.

26. The method of claim 25, further comprising receiving the stripped bag and insert combinations on a conveyor and carrying the stripped bag and insert combinations away from the bag carrying mechanism with the conveyor.

27. A bag carrying mechanism for a bag and insert combining apparatus, the bag carrying mechanism comprising:

a plurality of angularly spaced apart bag holding arrangements, the bag holding arrangements operably coupled to one another for rotation about a rotational axis, each bag holding arrangement of the plurality of angularly spaced apart bag holding arrangements having a receiving cavity;

each bag holding arrangement of the plurality of angularly spaced apart bag holding arrangements including:

a first holding feature for holding a first side of a bag received in the receiving cavity; and a second holding feature for holding a second side of the bag received in the receiving cavity, the first and second holding features being movable relative to one another to hold the bag received in the receiving cavity in an open state, and each bag holding arrangement of the plurality of angularly spaced apart bag holding arrangements carrying the bag carried in the receiving cavity in a vertically downward direction while holding the bag receive in the receiving cavity in the open state.

28. The bag carrying mechanism of claim 27, wherein the first and second holding features are vacuum ports.

29. The bag carrying mechanism of claim 27, wherein each bag holding arrangement includes a first arm segment and a second arm segment positioned adjacent the first arm segment forming a receiving cavity therebetween.

30. The bag carrying mechanism of claim 29, wherein for each bag holding arrangement, the first and second arm segments are movable relative to one another to adjust a spacing between the first and second arm segments.

* * * * *